US006357130B1

(12) United States Patent
Rank

(10) Patent No.: US 6,357,130 B1
(45) Date of Patent: Mar. 19, 2002

(54) DRAFTING TEMPLATE FOR PREPARING AXONOMETRIC DRAWINGS

(75) Inventor: David William Rank, 1427 Racine St., Menasha, WI (US) 54952

(73) Assignee: David William Rank, Menasha, WI (US)

( * ) Notice: Subject to any disclaimer, the term of this patent is extended or adjusted under 35 U.S.C. 154(b) by 0 days.

(21) Appl. No.: 09/309,144

(22) Filed: May 10, 1999

(51) Int. Cl.[7] ..... B43L 13/14

(52) U.S. Cl. ..... 33/562; 33/563; 33/1 K; 33/18.3; 434/85

(58) Field of Search ..... 33/562, 563, 564, 33/565, 1 G, 1 K, 18.3, 23.11, 481, 482, 474; 434/85, 88, 92

(56) References Cited

U.S. PATENT DOCUMENTS

| | | | | |
|---|---|---|---|---|
| 192,135 | A | 6/1877 | Somes | |
| 757,246 | A | 4/1904 | Ablett | |
| 846,006 | A | 3/1907 | Bryson | |
| 989,327 | A | 4/1911 | Brubaker | |
| 1,415,615 | A | 5/1922 | Stock | |
| 1,461,335 | A | 7/1923 | Vosler | |
| 1,723,517 | A | 8/1929 | McFadden | |
| 1,808,705 | A | 6/1931 | Owen, Jr. | |
| D137,459 | S | 3/1944 | Colmery | |
| 2,364,529 | A | 12/1944 | Hill | 33/104 |
| 2,593,914 | A | 4/1952 | Palitto | 33/104 |
| D195,225 | S | 5/1963 | Traum | D52/6 |
| 3,241,242 | A | 3/1966 | Dempsey | 33/174 |
| 4,235,022 | A | 11/1980 | Aldape | 33/474 |
| 4,462,168 | A | 7/1984 | Lynch et al. | 33/492 |
| 4,490,921 | A | 1/1985 | Woods et al. | 33/476 |
| 4,565,012 | A | 1/1986 | Bilodeau et al. | 33/458 |
| 4,734,993 | A | 4/1988 | Pan | 33/483 |
| 4,779,346 | A | 10/1988 | Schafer | 33/1 B |
| D311,873 | S | 11/1990 | Arend | D10/70 |
| 5,174,036 | A | 12/1992 | Lin | 33/449 |
| D374,404 | S | 10/1996 | Kidd | D10/71 |

*Primary Examiner*—Christopher W. Fulton
*Assistant Examiner*—Lydia M. De Jesús
(74) *Attorney, Agent, or Firm*—Wilhelm Law Service; Thomas D. Wilhelm

(57) ABSTRACT

A drafting template for preparing axonometric drawings or sketches comprising a unitary, clear, substantially planar, chevron-shaped body having an apex and an antapex, an upper face, a lower face, and at least six side edges. Various embodiments of the template provide for preparing trimetric, dimetric and isometric drawings or sketches. The template is provided with indicia on an upper or lower face thereof for measuring and scaling the drawing.

52 Claims, 6 Drawing Sheets

DRAFTING TEMPLATE FOR PREPARING AXONOMETRIC DRAWINGS

TECHNICAL FIELD

The present invention relates to drafting instruments. More particularly, the present invention concerns a template for preparing axonometric drawings.

BACKGROUND OF THE INVENTION

So-called "mechanical drawings" are generally rendered using one of four different projections. In multi-view projection, the object is presented to the viewer on the drawing paper in front, side and top views. This method of projection is best for depicting objects of considerable complexity, and is ideal for showing dimensions, hidden lines, etc. However, a multi-view drawing is often difficult for persons not skilled in the drafting arts to visualize in three dimensions.

For this purpose, one of three "pictorial" projections is often used: oblique projection, perspective projection, and axonometric projection. In oblique projection, the observer is considered to be at an infinite distance from the object, hence lines between points on the object in real space and corresponding points on the rendered object on the plane of projection (i.e. the drawing sheet) are parallel, but form oblique angles with respect to the projection plane.

In perspective projection, typically used in art, the observer is considered to be at a finite distance from the projected object, and visual rays drawn from the observer's eye (the "station point") to all points of the object form a cone of rays. All lines which are parallel in the object in real space are thus seen as lines which converge to a "vanishing point" on the horizon. This example of projection renders a three-dimensional object in a most visually "correct" manner on a two-dimensional surface, since this is the manner in which the human eye perceives objects in real space. Perspective projection is best illustrated in architectural paintings of the Renaissance Italianate school of painting. However, since parallel lines on the real object converge to the vanishing point in the drawing, it is not possible to take dimensional measurements directly from the drawing.

Axonometric projections, as the name implies, permit measurements to be taken parallel to the coordinate axes of the drawing and are thus in common use in mechanical drafting. In axonometric projection, the object is inclined with respect to the plane of projection about two of its three Cartesian coordinate axes in real space with all imaginary lines drawn from points on the real object to corresponding points on the projected object being parallel. The general term "axonometric projection" thus applies to the infinite variety of angles with which an object may be tilted or inclined with respect to the projection plane. These include so-called isometric, dimetric, and trimetric projections. Examples of these three types of axonometric projections are depicted in FIG. 1. In FIG. 1*a*, the front face 1-2-3-4 of a cube is shown in a typical multi-view drawing. FIG. 1*b* shows a trimetric projection of that cube; FIG. 1*c* depicts a dimetric projection; and FIG. 1*d* shows an isometric projection of the cube.

Rotation about the Cartesian coordinate axes of a real space object and subsequent projection upon a flat plane to produce an axonometric projection drawing results in the corresponding foreshortening of the scales of the axes. In an isometric projection, the rotation is about two of the three axes by equal amounts of 45°. The result is that the scales of all three coordinate axes in the projected drawing are foreshortened by the same amount. In a dimetric projection, rotation of the Cartesian coordinate axes similarly takes place around two of the axes, but rotation about one of the axes is through an angle of 45°, while rotation about the other axis is through an acute angle other than 45°. There results a similar foreshortening of the scales of the three axes, but with two of the axial scales foreshortened by the same amount, and the third by a different amount. Finally, in a trimetric projection, rotation of the Cartesian coordinate axes takes place about two of the three axes, but through unequal acute angles not equal to 45°. In this case, the scales of all three rotated coordinate axes are foreshortened, but by unequal amounts.

Typically, axonometric drawings are prepared either manually, with the aid of a T-square and a drawing triangle having the appropriate angles, by a mechanical drafting machine, or more recently, by a computer-assisted design (CAD) software program and computer. However, there are numerous occasions where axonometric drawings or sketches must be prepared under circumstances where neither the necessary drafting instruments or a properly programmed computer is available. In these situations, there is a need for a drafting device which is inexpensive, easily transportable, and simple to use, but which renders axonometric drawings of a quality equal to those rendered by a drafting machine or by CAD.

SUMMARY OF THE INVENTION

The present invention provides, in its principal embodiment, drafting template for preparing axonometric drawings or sketches comprising a unitary, clear, substantially planar, chevron-shaped body having an apex and an antapex, an upper face, a lower face, and at least six side edges.

The unitary chevron-shaped drafting template of the present invention, if divided into two legs by a line connecting the apex and antapex, in various embodiments describes a shape in which either or both legs may be the shape of a trapezoid or parallelogram and may be of equal or different lengths.

Depending upon the angles formed between a first upper edge of the drafting template and the line connecting the apex and antapex, and between the second upper edge of the drafting template and the line connecting the apex and antapex, the drafting template of the present invention in various embodiments is adapted for rendering trimetric, dimetric or isometric drawings.

In a preferred embodiment, the drafting template of the present invention further comprises indicia disposed on a face of the body for measuring and scaling the drawing or sketch.

BRIEF DESCRIPTION OF THE DRAWING FIGURES

IN THE DRAWING:

FIG. 1 shows a three dimensional cube in four projections:

FIG. 1*a* depicts a flat frontal view of a cube in multi-view projection; FIG. 1*b* shows a trimetric projection of a cube; FIG. 1*c* shows a dimetric projection of a cube; and FIG. 1*d* shows an isometric projection of a cube.

DETAILED DESCRIPTION

As used throughout this specification and the appended claims, terms have their generally understood definitions and meanings as can be found in any standard dictionary of the English language. In particular, with regard to the definitions of angles, an "acute" angle is one having a value greater that 0°, but less that 90°; an "obtuse" angle is one having a value greater than 90°, but less than 180°; and a "reflex" angle is one having a value greater than 180°, but less than 360°.

An "interior" angle or an "inside" angle is an angle formed between two adjacent sides of a rectilinear figure such as a polygon, and lying wholly within the polygon. An angle is said to be an "outside" angle with respect to a polygon if it is an angle formed by two adjacent sides of the polygon, but lying wholly outside the polygon.

Two angles are said to be "complementary" if the sum of their values forms a right angle of 90°. Similarly, two angles are said to be "supplementary" if their sum is a straight angle of 180°.

Figure 3:
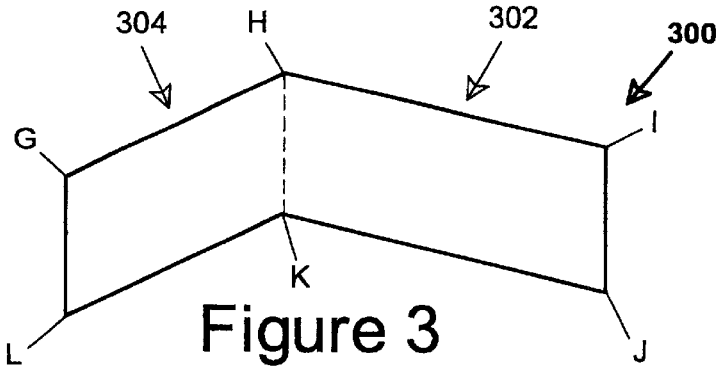
Figure 4:
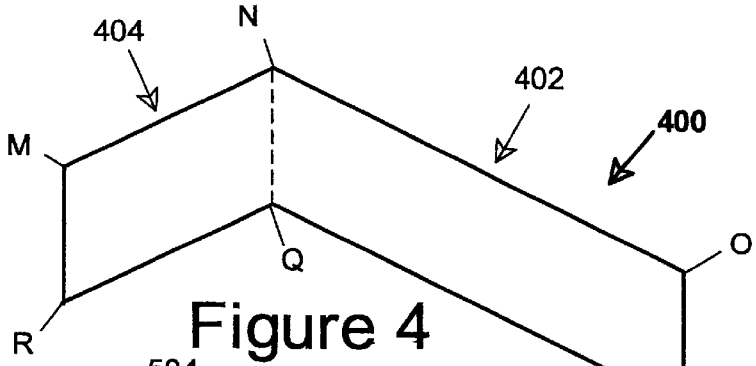

The term "chevron-shaped" figure denotes a figure consisting of two diagonal stripes which meet at an angle. That is, as used throughout this specification and the appended claims, a chevron-shaped figure is one having first, second, third, fourth, fifth, and sixth side edges, denominated as one moves in a clockwise manner about the chevron-shaped body. The first and second upper side edges meet at an angle to form the apex of the chevron-shaped body, and fourth and fifth lower side edges meet at an angle to form the antapex of the chevron-shaped body, when the chevron is viewed as an inverted V. The first and fifth side edges of the figure are spaced apart and parallel to one another and the second and fourth side edges are spaced apart and parallel to one another. A third end edge connects the end of the second side edge, at a point distal from the apex, to a point of the fourth side edge distal from the antapex. Similarly a sixth end edge connects a point on the first side edge, distal from the apex, to the fifth side edge at a point distal from the antapex. Various chevron-shaped figures are depicted in FIGS. 2, 3 and 4.

Figure 2:
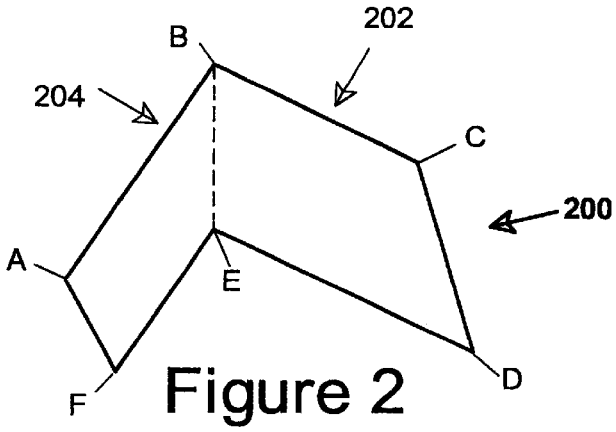
FIGS. 2, 3, 4 and 5 show different embodiments of the shapes of a drafting device of the present invention.

The term "apex" of a chevron-shaped figure means the point of meeting of the top edges of the two legs of the chevron when the chevron is viewed as an inverted V (point B in FIG. 2, for example). The term "antapex" of a chevron-shaped body denotes the point of meeting of the lower edges of the two legs of the chevron, again when viewed as an inverted V (point E in FIG. 2, for example).

The term "clear" as applied to the drafting template of the present invention denotes a transparent, translucent, tinted, frosted, or etched body which retains sufficient clarity to permit discernment of the lines of a drawing when the template is laid flat on the drawing and the drawing lines are viewed through the template.

Suitable materials for fabricating the drafting template of the present invention are various clear plastics well known in the art such as acrylates, polyethylene, polypropylene, polyesters and polycarbonates, with polycarbonate materials being preferred because of their resistance to breakage upon bending. A particularly preferred material is Lexan® polycarbonate, available from General Electric Company, 1 River Road Schenectady, N.Y.

Figure 1:
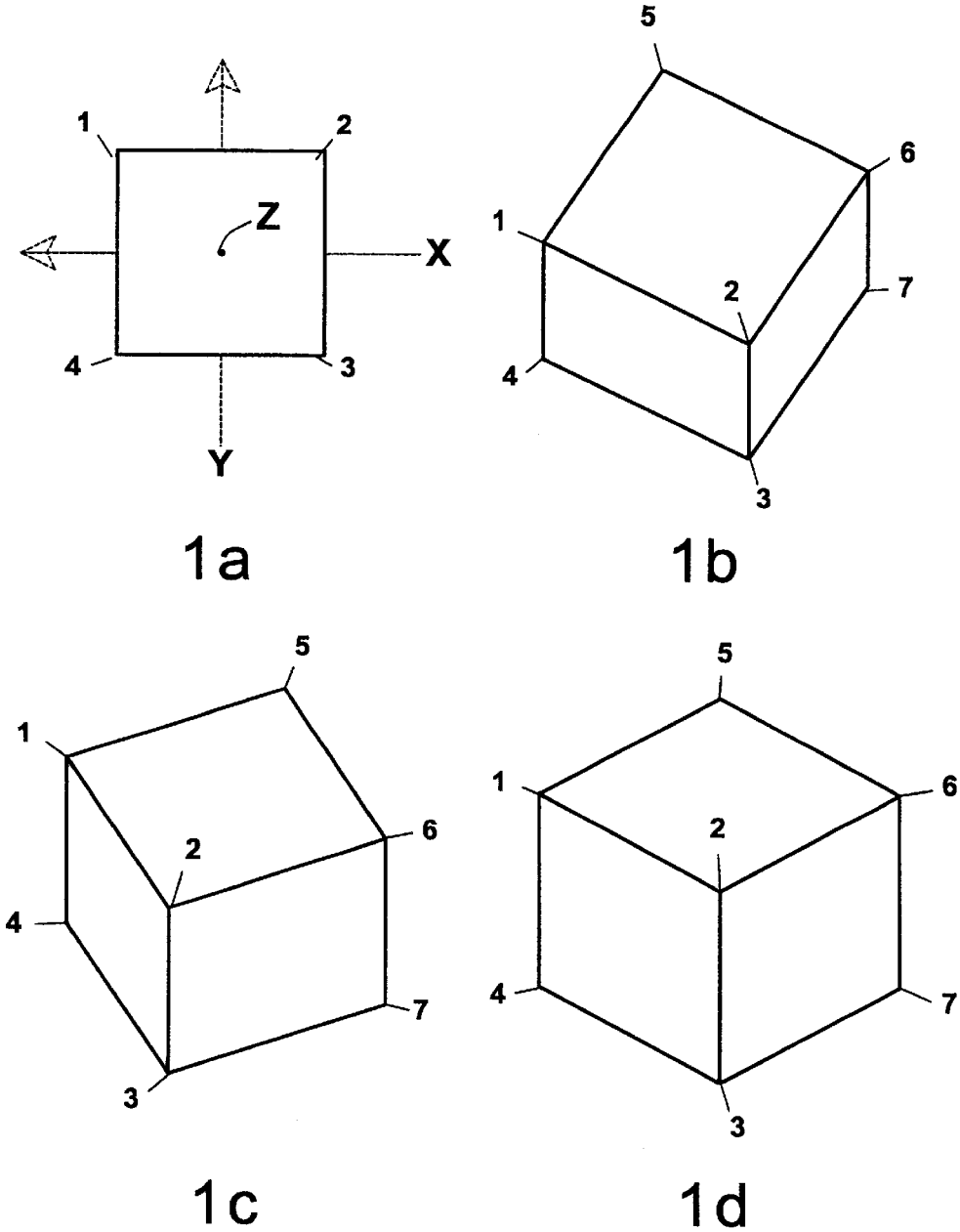

Referring to FIG. 1, FIG. 1*a* shows the front face 1-2-3-4 of a cube in a typical multi-view projection, together with the three mutually orthogonal Cartesian coordinate axes X, Y, and Z passing through the three orthogonal faces of the cube. In FIG. 1*a*, the X and Y axes are to be viewed as lying in the plane of the paper, with the Z axis coming out of the plane of the paper and depicted as a dot.

In FIG. 1*b*, the cube of FIG. 1*a* has been rotated through angles of other than 45° about both the X and Y axes. The rotations have been such that the corner point 1 of the cube has moved forward out of the pane of the paper, with all other corner points being in front of, on, or behind the plane of the paper, depending upon the amounts of rotation about each of the X and Y axes. Following this rotation, the rotated cube has been projected flat on the plane of the paper to produce a so-called trimetric projection. In the trimetrically rendered cube of FIG. 1*b*, the actual lengths of lines 1-2, 2-6 and 2-3 are unequal to one another, as are angles 1-2-3, 3-2-6 and 1-2-6.

In FIG. 1*b*, the real space cube has been rotated by 45° about the X axis, and by a lesser angle about the Y axis. Following the rotation, the rotated cube has been projected onto the flat plane of the paper. In this rendition of the cube, termed a dimetric projection, lines 1-2 and 2-3 are equal in length, but of a length different than that of line 2-6. Angles 1-2-6 and 3-2-6 are likewise equal, but of a value different to that of angle 1-2-3.

Finally, in FIG. 1*d*, the real space cube has been depicted in isometric projection by first rotating the cube about both the X and Y axes by 45° and subsequently projecting the rotated cube onto the flat plane of the paper. In the isometric view, all three lines, 1-2, 2-6 and 2-3 are of equal length, and the angles 1-2-3, 6-2-3, and 1-2-6 are all equal.

Four embodiments of the drafting template of the present invention are depicted in FIGS. 2–5. In the most general case, depicted in FIG. 2, there is shown a template 200 for rendering trimetric drawings. The template 200 comprises a unitary body of six sides forming a chevron-shape. First side AB and fifth side EF are parallel, as are respective second and fourth sides BC and DE. In this most general embodiment, the end edges CD and AF are neither parallel to one another nor to the line BE connecting the apex B and antapex E. As a consequence, the two legs 202 and 204 formed by dividing the body of the template 200 with the dotted line BE connecting the apex and antapex, are trapezoids. However, it is to be understood that either, or both of the end edges CD and AF can be parallel to one another with or without being parallel to the line BE connecting the apex and antapex. The preferred embodiment is one in which both end edges are parallel to the line connecting the apex and antapex, with the two legs of the chevron-shaped template thus describing parallelograms.

In the embodiment shown in FIG. 3, the template is suitable for rendering dimetric drawings. As with the trimetric template, first side edge GH is parallel to fifth side edge KL and second side edge HI is parallel to fourth side edge JK. However, unlike the general case of the template of FIG. 2, the embodiment of FIG. 3 is shown with end edges IJ and LG both parallel to one another. This is a preferred feature of the drafting templates of the present invention. It is particularly preferred that the end edges of the template be not only parallel to one another, but also to the reference line connecting the apex and the antapex of the chevron-shaped template. Thus, the two legs 302 and 304 formed by dividing the template 300 of FIG. 3 with line HK, joining the apex and antapex, are parallelograms. That is, as shown in FIG. 3, end edges IJ and LG are parallel to one another, as well as to apex-antapex reference line HK.

The feature which distinguishes the drafting templates of FIGS. 2, 3, and 4 is the interior angle formed between the first upper edge of the chevron shaped template and the line connecting the apex and antapex, and the angle formed between the second upper edge of the chevron-shaped template and the line connecting the apex and antapex. The term "upper edge" of the template refers to the first and second edges when the template is viewed as an inverted letter "V". These angles are described in further detail below.

The most preferred embodiment of the shape of the drafting template of the present invention is shown in FIG. 4. The embodiment depicted there is adapted for rendering isometric drawings. As in the embodiment depicted in FIG. 3, the two legs 402 and 404 of the template body 400 are parallelograms.

Figure 5:
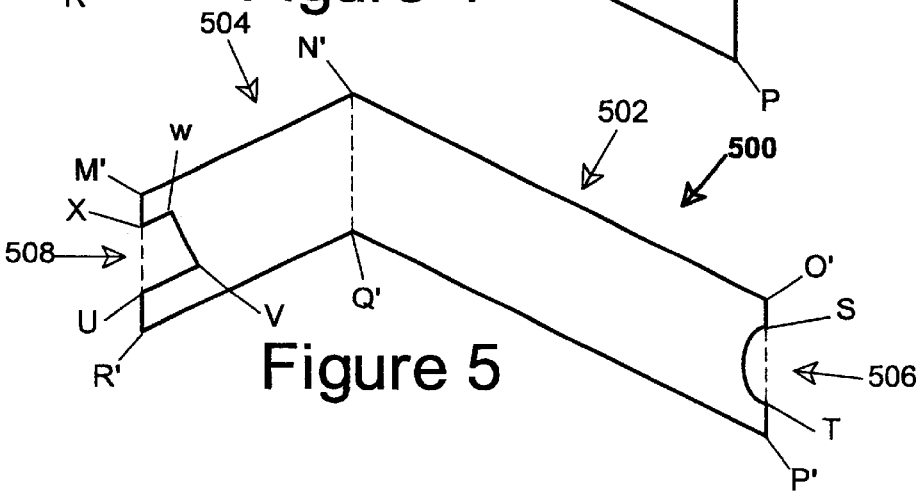

When the drafting template of the present invention is described generally as having a "hexagonal shape" or being a "six-sided" figure, reference is to the general chevron-shapes depicted in FIGS. 2–4. However, templates having more than six sides are also contemplated as falling within the scope of the invention if their principle shape is that of a chevron. For example, the template embodiment depicted in FIG. 5, while having more than six sides, is contemplated by the present invention. In FIG. 5, the same isometric template as in FIG. 4 is shown, but with additional cut-outs 506 and 508. Cut-out 506 represents an arc ST of an ellipse, and cut-out 508 represents a rectilinear cut-out formed by lines UW, VW, and WX. These cut-outs provide mini-templates which may take the form of arcs of a circle or ellipse, or of a polygon of any desired shape. When the cut-outs are provided in the drafting template of the present invention, it is preferred that they be placed in one or both end edges of the chevron-shaped template.

In fabricating a template for axonometric projection drawings, in accordance with the present invention, the interior angles formed, respectively, by the first and second top edges of the chevron-shaped body and the apex-antapex reference line (when the template is viewed as an inverted letter "V") are critical in determining what type of axonometric drawing will be produced. Each of these interior angles must be greater than 0° but not supplemental to one another. Preferably, the angles, in combination, are greater than 90° but not supplemental to each other. For example, in FIG. 2, angles ABE and CBE are different angles, not equal to 60°, and together, form an angle ABC of less than 180°; the resulting template renders trimetric drawings. To render a dimetric projection drawing, as with the template depicted in FIG. 3, one of the angles formed between the respective a top edge of the template and the apex-antapex reference line must be 60°, with the other being greater than 0° but not supplemental to the other, nor of a value equal to 60°. Thus in FIG. 3, angle GHK is 60°, while angle IHK is other than 60°, and the two angles combined form an angle GHI of less than 180°. Finally, to render isometric projection drawings, both angles formed between the respective top edges of the chevron-shaped template body and the line connecting the apex-antapex line(when viewed as an inverted letter "V") must be 60°. In the isometric template of FIG. 4, angles MNQ and ONQ are both 60°.

It can be seen by studying FIGS. 2–4 that as one of the angles formed between a top edge of the chevron-shaped body and the apex-antapex line approaches 0°, the corresponding leg of the template approaches extinction. Similarly, as the two angles formed between the top side edges of the chevron-shaped template body and the apex-antapex reference line approach a sum of 180°, the two legs of the chevron approach a single trapezoid or parallelogram. Moreover, near the ends of these ranges of angles, the rendered drawings become more and more distorted. On the other hand, as the angles approach 60°, the three embodiments of the template merge into one another. That is to say, as one of the non-60° angles of a trimetric template approaches 60°, the resulting template body approaches in shape that of a dimetric template. Similarly, as the non-60°0 angle of the dimetric template approaches 60°, the resulting template body approaches in shape that of an isometric template.

For these reasons, the operable and preferred ranges of angles for the three template embodiments of the invention are as follows. If the chevron-shaped template body is viewed as an inverted V, and the angle between the upper left-hand edge of the template and the apex-antapex line is referred to as "Angle 1" and the angle between the upper right-hand edge of the template and the apex-antapex line is referred to as "Angle 2":

For a trimetric template, the operable angles are:

0°<Angle 1<60° and 60°<Angle 1<90° and

0°<Angle 2<60° and 60° <Angle 2<(180°- Angle 1).

For a trimetric template, the preferred angles are:

5°<Angle 1<55° and 65°<Angle 1<85°; and

5°<Angle 2<55° and 65°<Angle 2<(180°-Angle 1).

For a dimetric template, the operable angles are:

Angle 1=60°; and

0°<Angle 2<60° and 60°<Angle 2<(120°).

For a dimetric template, the preferred angles are:

Angle 1=60° and

5°<Angle 2<55° and 650<Angle 2<(115°).

For an isometric template, the operable and preferred angles are:

Angle 1=60°

Angle 2=60°

Figure 6:
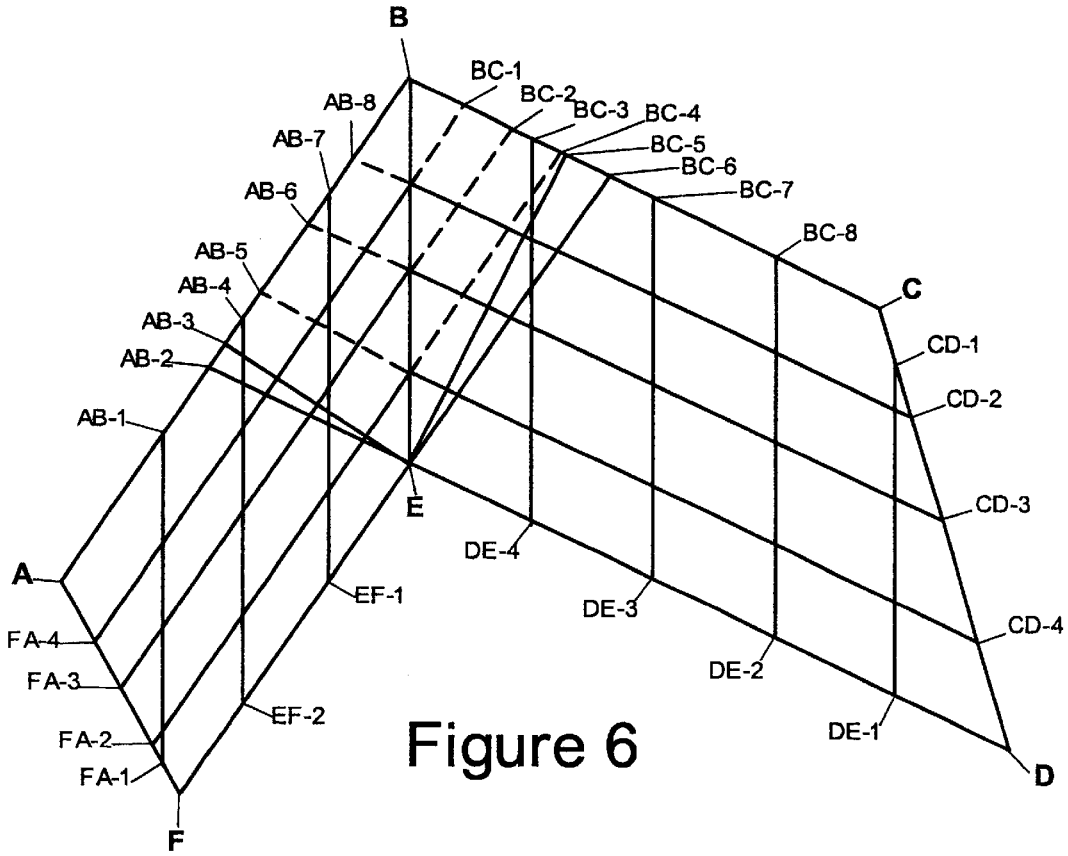
FIG. 6 depicts the embodiment of the drafting template of FIG. 2 for rendering trimetric drawings, including indicia for scaling the drawing.
Figure 7:
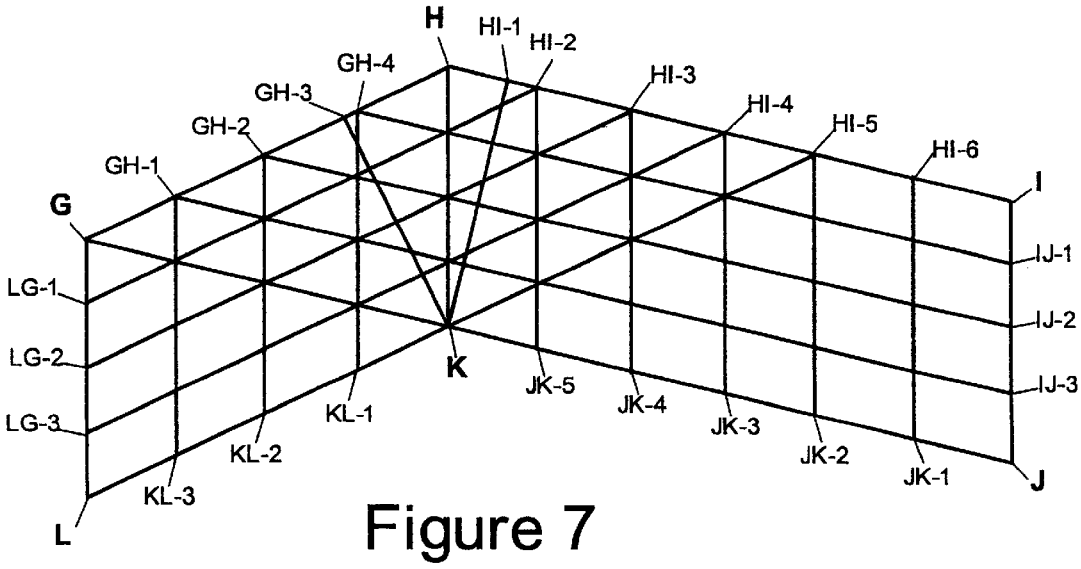
FIG. 7 depicts an embodiment of the drafting template of FIG. 3 for rendering dimetric drawings, including indicia for scaling the drawing.
Figure 8:
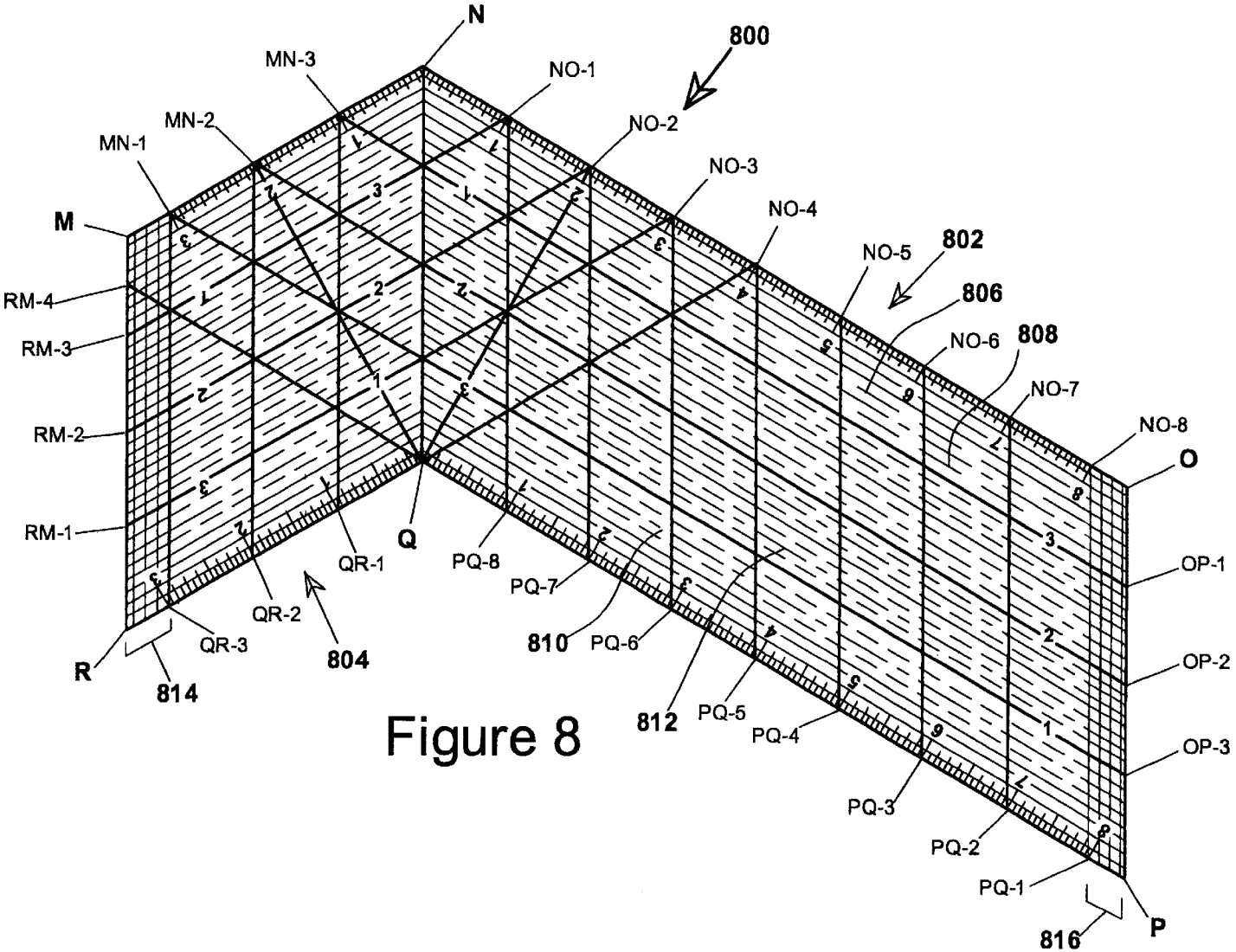
FIG. 8 shows a preferred embodiment of the drafting template of the present invention for rendering isometric drawings, with indicia for measuring and scaling the drawing.

In FIGS. 6, 7 and 8, the trimetric, dimetric and isometric templates of FIGS. 2, 3 and 4, respectively, are shown with indicia which aid both in the alignment of the template with the drawing during drafting, and in measuring and scaling the projected drawing. The indicia may take the form of lines which are printed, silk-screened, embossed, etched, or otherwise affixed to one of the upper or lower faces of the template body. It is preferred that the indicia be placed on the lower face of the template, that is, on the face of the template which is closest to the drawing paper during use. This arrangement eliminates parallax error which might otherwise be introduced if the indicia are placed on the upper face of the template.

If the indicia are affixed to the lower (paper-side) face of the template, to prevent the indicia from being abraded away over time by sliding the template about on the paper, a number of schemes may be employed. In one alternative, the lines and numbers comprising the indicia are lightly scored or etched into the face of the template, with ink or paint flowed into the scoring or etching for highlighting. In this alternative, if the ink or paint becomes faint through use, it is a simple matter to simple wipe ink or paint across the lower face of the template and wipe away the excess to "re-ink" the indicia. In another alternative, the indicia are printed or silk-screened on the lower face of the template, with a protective adhesively or thermally bonded layer of laminate applied thereover. This is the preferred method of affixing the indicia to a face of the template. A third alternative, although less preferable because of the parallax problem alluded to above, is to form the template body by molding or stamping to produce raised indicia on the upper face of the template. This alternative also suffers from the drawback that the fineness of detail of the indicia markings is somewhat compromised. That is, indicia lines which are printed or silk-screened onto the template body can be much finer. Generally a line pitch of equal to or less than about 0.02 inches (0.5 mm) is preferred. In this manner, if a standard 0.5 mm (0.02 inch) drafting pencil is used to construct the drawing, lines on the template are of equal thickness. When the template is aligned over a line on the drawing, the template can be accurately positioned by insuring that the underlying line on the drawing is totally obscured by the corresponding indicia line on the template.

The preferred arrangement of the markings to be placed on the face of the template are shown in the isometric template of FIG. 8. There, the template 800 comprises a chevron-shaped body having two legs 802 and 804 formed by dividing the body with line NQ which connects the apex N and the antapex Q of the body 800. As discussed above, in this preferred embodiment, left and right legs 802 and 804 of the template 800 define parallelograms MNQR and NOPQ, respectively.

The line NQ, or apex-antapex reference line, is the principal or "reference" indicia line of the marked template. It is used for basic orientation the template during drafting. Since this line corresponds to the Z axis of both the real space object and the axonometric projection, and since the real space object is not rotated about the Z axis, the apex-antapex reference line has the status of a special reference line on the template. Next in importance are the two lines running from the antapex point Q to points MN-2 and NO-2. The first line is perpendicular to opposite side edge MN, and the second is perpendicular to opposite side edge NO. These lines permit orienting the drafting template to render lines drawn along edges MN and RQ perpendicular to any line in the drawing which coincides with line Q-MN-2. Likewise, aligning the template line Q-NO-2 to any line in the drawing permits the construction of perpendicular lines along edges NO or PQ. A special use of lines Q-NO-2 and Q-MN-2 are their use in aligning the template with the edge of the drafting sheet to render vertical reference lines on the drawing sheet.

A first principal set of lines running parallel to second side edge NO and fourth side edge PQ, centered between second side edge NO and fourth side edge PQ, and equally spaced apart from one another, connect third end edge OP to the opposite side edge MN. Similarly, a second principal set of lines running parallel to first side edge MN and fifth side edge QR, centered between first side edge MN and fifth side edge QR, and equally spaced apart, connect sixth end edge MR to the opposite side edge NO. These lines are principal lines on the template and are therefore preferably rendered as solid lines of a thickness of 0.02 inches (0.5 mm). These principal lines are spaced apart from one another by one unit of measure, the unit chosen based upon the measurement system employed in constructing the template (for example by one inch or one centimeter). The spacing of the lines is measured along a line parallel to the apex-antapex reference line.

A third intermediate set of lines such as lines 806, 808, 810 and 812, parallel to side edges NO and PQ, run from end edge OP and opposite slide edge MN and are centered and spaced evenly between, the first principal set of lines. Similarly, a fourth intermediate set of lines such as lines 807 and 809, parallel to fist side edge MN and fifth side edge QR run from end edge MR to opposite side edge NO and are centered and spaced evenly between the second principal set of lines.

The spacing of these intermediate lines from one another will depend upon the measurement scale employed (i.e. English or metric), and may be of any desired amount; in the embodiment shown in FIG. 8, the lines are spaced by one-eighth inch (0.159 cm). These intermediate lines are preferably rendered on the template as solid, dashed, or broken lines of a thickness of 0.01 inches (0.025 mm).

A fifth principal set of lines (eg. lines NO-1-PQ-8 and NO-4-PQ-5) parallel to the apex-antapex reference line NQ, connect second side edge NO and fourth side edge PQ. This fifth principal set of lines is preferably centered between and parallel to the apex-antapex line NQ and end edge OP and equally spaced from one another. Similarly, a sixth principal set of lines (eg. lines MN-1-QR-3 and MN-3-QR-1) connect first side edge MN and fifth side edge QR. This sixth principal set of lines are centered between the apex-antapex lined NQ and are evenly spaced from one another. As with the first and second principal sets of lines, these fifth and sixth principal sets of lines are evenly spaced by one unit of measure (one inch or one centimeter). When reference is made to the spacing of these fifth and sixth sets of indicia lines on the drafting template, spacing is measured along one of the first or second principal sets of lines. That is, the spacing of the fifth principal set of lines is measured along one of the first principal sets of lines, and the spacing of the sixth principal set of lines is measured along one of the second principal sets of lines.

The upper and lower side edges MN and NO and QR and QP of the chevron-shaped template (when viewed as an inverted letter "V") are preferably marked with linear scales. In the preferred embodiment shown in FIG. 8, the linear scales appear as hash marks or short lines, perpendicular to the edges of the template and marked with a numeric scale. The scale is appropriately sub-divided; in the embodiment depicted in FIG. 8, at every sixteenth inch (each 0.159 cm). These scales, whether English or metric, are "true scales." That is, if the scale reads one inch, the actual distance measures one inch. In this manner, whether the template renders a trimetric, dimetric, or isometric projection drawing, a reader of the drawing can take measurements parallel to any axis of the projection directly from the drawing.

A preferred additional feature of the template depicted in FIG. 8 are end zones 814 and 816. End-zone 814 comprises, in the embodiment shown, an extra one-half inch added to the end of leg 804 of the template 800; end zone 816 comprises an extra one-half inch added to the end of leg 802 of the template 800. In each end zone in the embodiment shown in FIG. 8, the end zone indicia markings form thin (i.e. 0.01 inch or 0.025 mm) solid lines, spaced by one-eighth inch (0.318 cm) and respectively parallel to end edge OP or MR. In some embodiments, the intersection of end zone indicia lines with one or more of ones of the first principal set of lines, the second principal set of lines, the third intermediate set of lines, and the fourth intermediate set of lines defines angles, preferably not equal to 90°.

Certain principle lines in the template permit the rendering of lines forming important angles. The use of lines Q-MN-2 and Q-NO-2 in drawing right angles has already been discussed. In addition, lines NO-4-Q and Q-MN-2 form a right angle. Numerous 30° angles can be picked out on the template of FIG. 8: angles N-Q-MN-2, N-Q-NO-2, for example. Numerous 60° angles are formed, for example, angles MRQ and OPQ, etc. One-hundred-twenty degree angles are formed, for example, by angles MNO and NO-4-Q-RM-4. Thus, the preferred drafting template of the present invention, in addition to aiding in the rendition of isometric projection drawings, can stand in as a replacement for the traditional 30°-60°-90° drafting triangle.

While the preferred template depicted in FIG. 8 has been marked with so-called "English" units of linear measure, other embodiments may be constructed according to the principles of this invention using other scales, such as the metric or "S.I." scale.

One final point with regard to the preferred isometric template of FIG. 8. It will be noted in comparing the isometric template of FIG. 8 with the dimetric and trimetric templates depicted in FIGS. 6 and 7 (to be discussed below), that there are more "convergent" lines in the isometric template. That is, because of the various angles involved in the template, many sets of lines converge at single points. For example, there are two points of four-line convergence: one is represented by the convergence of lines OP-3-MN-1, Q-MN-2, RM-2-NO-2, and MN-3-QR-1. These convergence points detract considerably from the visual "clutter" of the template, which is evident in the dimetric and trimetric templates.

Turning to FIGS. 6, there is shown the trimetric template ABCDEF of FIG. 2 with only the "principal" indicia marking lines shown for the sake of clarity. It is to be understood, however, that a trimetric template can be fabricated with a complete set of indicia, including linear edge scales as in the isometric template of FIG. 8.

Again, the principal lines on the template include the apex-antapex reference line BE and the lines E-AB-3 and E-BC-5 drawn respectively perpendicular to side edges AB and BC and passing through the antapex point E. Lines (e.g. AB-4-EF-2 and BC-7-DE-3), parallel to the apex-antapex reference line BE are spaced apart equally by one inch (2.54 cm) on both legs of the chevron-shaped body. Lines (e.g. CD-4-AB-5 and CD-2-AB-8), parallel to side edges BC and DE are spaced apart equally, also by one inch (2.54 cm). Lines (e.g. FA-4-BC-1 and FA-2-BC-4 are similarly spaced apart by one inch (2.54 cm) and parallel to sides AB and EF.

Comparing FIGS. 6 and 8 it can be seen that the marked trimetric template of FIG. 6 would appear much more cluttered than the isometric template of FIG. 8 if all of the additional lines of the template of FIG. 8 were to be added to the template of FIG. 6. This is because of the different axial scales along the projected drawing coordinate axes represented by sides EF, EB and ED. As a consequence, the extension of the intermediate lines (e.g. line CD-3-AB-6 past the apex-antapex reference line BE does not meet line EF-1-AB-7 at side AB as is the case for corresponding lines in the isometric template. This is just one example of the numerous instances of the lack of "convergence" of lines in the trimetric template.

Some of this line convergence is regained in the dimetric template depicted in FIG. 7 where, again, only the principal lines of the indicia are shown. This is a result of the fact that angle GHK is 60°. As in the two templates described above, the dimetric template of FIG. 7 has two lines K-GH-3 and K-HI-1 respectively perpendicular to sides GH and HI, and the important apex-antapex reference line HK. Lines parallel to the apex-antapex line such as KL-2-GH-2 and JK-4-HI-3 are spaced apart by one inch (2.54 cm). Each leg of the chevron-shaped dimetric template of FIG. 7 also has one-inch (2.54-cm) spaced apart lines parallel to the side edges of the leg. Thus, for example, line LG-3-HI-4 is parallel to sides GH and KL, and line IJ-2-GH-2 is parallel to sides JK and HI.

As discussed above, the rotation of a real space object, and subsequent projection of the rotated object onto a plane of paper results in foreshortening of the actual lengths of lines in the drawing when compared with the length of corresponding lines on the real space object. However, in each of the templates described above, the scales along the three projected axes have been "normalized" to real space. By the term "normalization" is meant the establishment of a 1:1 correspondence between dimensions on the real space object to dimensions on the axonometrically projected drawing. That is, if the real space object measures one inch (2.54 cm) along one of the rectilinear Cartesian coordinate axes in real space, it will likewise measure one inch (2.54 cm) along the corresponding rotated and projected axis in the drawing. This permits a craftsman to directly take measurements from the drawing. The result, however, is the distortion of the object somewhat in the dimetric and trimetric projections. This can be seen by reference to the trimetric, dimetric, and isometric projections of a cube shown respectively in FIGS. 1*b*–1*d*. The distortion relates to the amounts of rotation about the X and Y coordinates of the real space object prior to projection onto the plane of paper. This distortion is eliminated in the case of the isometric projection, another reason why isometric projections are preferred by draftspersons.

However, there are circumstances under which a trimetric or dimetric projection may be preferred. As can be seen by reference to FIG. 1*d*, an isometric projection presents all three faces of the real space object equally to the viewer. In the trimetric projection of FIG. 1*b*, the top face 1-2-6-5 of the projected cube is emphasized, while in the dimetric projection of FIG. 1*c*, the top face 1-2-6-5 and the front face 2-6-7-3 of the cube are emphasized, while the left-hand face 1-2-3-4 has been de-emphasized. In rendering a real space object axonometrically, where there is considerably more detail on one or more of the faces of the real space object, a dimetric or trimetric project may be the preferred projection.

Figure 9:
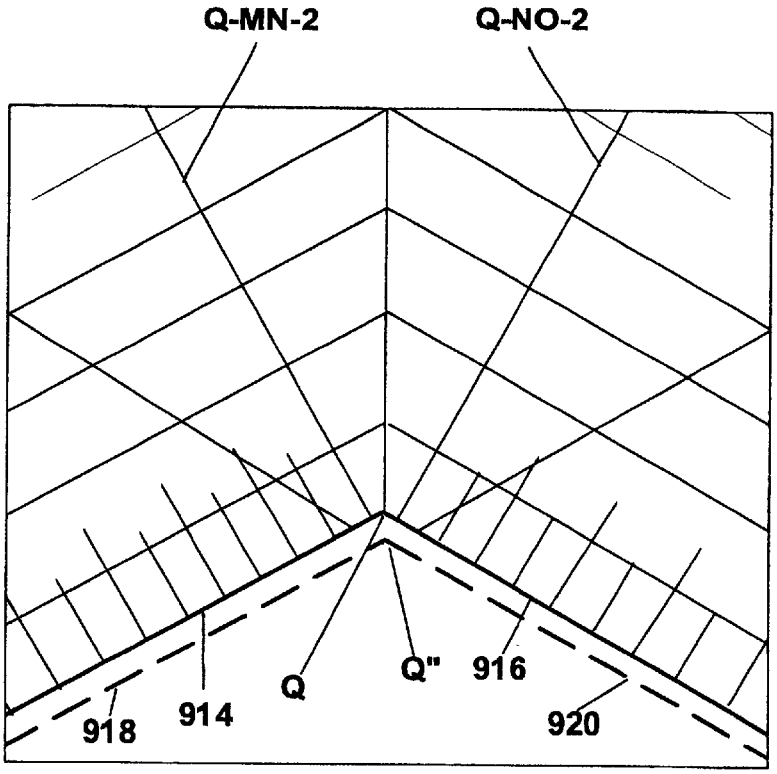
FIG. 9 shows an enlarged view of the region around point Q of the drafting template depicted in FIG. 8.
Figure 10:
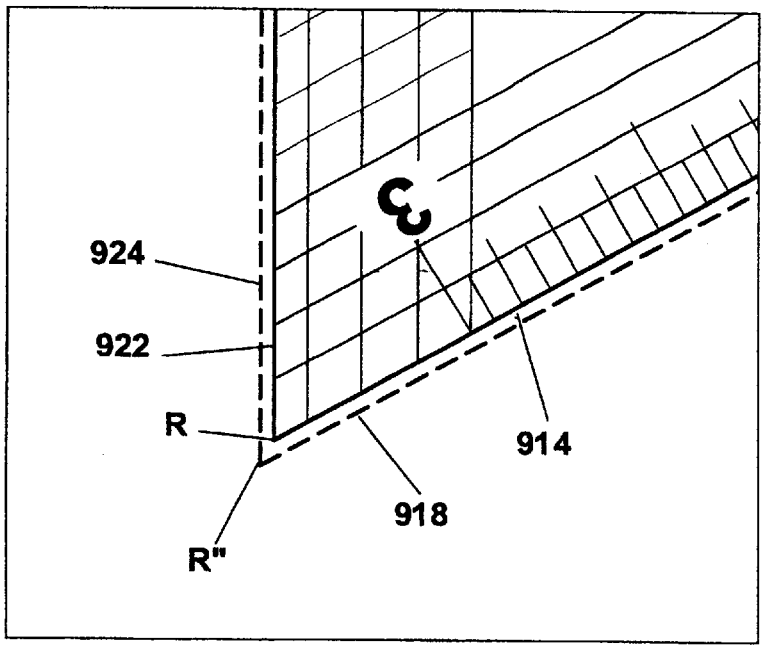
FIG. 10 shows an enlarged view of the region around point R of the drafting template depicted in FIG. 8.

In FIG. 9, there is shown an enlarged view of the isometric template of FIG. 8, centered around the antapex point Q. FIG. 10 shows an enlarged view of the isometric template of FIG. 8 centered around corner point R. These two Figures illustrate an additional preferred feature of the drafting templates of the present invention. The dimensions of the template are adjusted inwardly or inset from their true positions to leave a gap around the perimeter of the template equal in width to a normal mechanical drafting pencil lead. That is to say, there is a gap or inset, extending around the entire perimeter of the drafting template between the "true" edge or end position of the template and the actual edge of the template as constructed. Since a typical drafting pencil is common usage has a lead thickness of 0.5 mm, this gap or inset is preferably of a width of 0.5 mm (0.02 inch). To illustrate this point, if the true lengths of side edges NO and PQ of the template embodiment shown in FIG. 8 are 8.5 inches (21.59 cm), the end edge OP is inset from its true position by an amount of 0.5 mm (0.02 inch), making actual side edge NO equal to 21.54 cm, or 8.48 inch. Similarly, since both side edges NO and PQ would be inset by 0.5 mm (0.02 inch), the length of end edge OP would be shortened from its true length by 1 mm or 0.04 inch. In the template embodiment shown in FIG. 8, the true dimension of end edge OP is 4 inches (10.16 cm), so its actual constructed dimension, with the appropriate inset would be 3.96 inch (10.06 cm). Similar results would obtain for side edges QR and MN and end edge MR.

Referring to FIG. 9, the true edge of the template is represented by dotted lines 918 and 920, with the actual edges 914 and 916 respectively spaced inwardly therefrom by 0.5 mm (0.02 inches). The result is that no errors of dimension are introduced into the drawing by the thickness of the pencil lead. Rather, pencil lines drawn along edges of the template are drawn in their correct positions. Moreover, as can be seen in FIG. 9, the two lines Q-MN-2 and Q-NO-2 which are respectively perpendicular to sides MN and NO (cf. FIG. 8) do not pass through point Q on the actual edge of the template, but rather through imaginary point Q' which is formed by the meeting of the true edges 918 and 920 of the template.

In FIG. 10, the detail around corner point R of the isometric template of FIG. 8 shows that the actual edges 914 and 922 of the template are set inwardly, preferably by a distance of 0.5 mm (0.02 inch) from the respective true edges 918 and 924.

Referring again to FIG. 8, this set-back of the periphery of the template to accommodate the thickness of the drafting pencil lead means that edge MN (and correspondingly parallel edge QR) are shortened by 0.5 mm (0.02 inch) at their respective ends distal from the apex or antapex. Similarly, edges NO and QP are shortened by 0.5 mm (0.02 inch) at their respective ends distal from the apex and antapex. In a similar manner, the lengths of the apex-antapex reference line NQ and the parallel end edges MR and OP are shortened by 0.5 mm (0.02 inch) at each end thereof.

Figure 11:
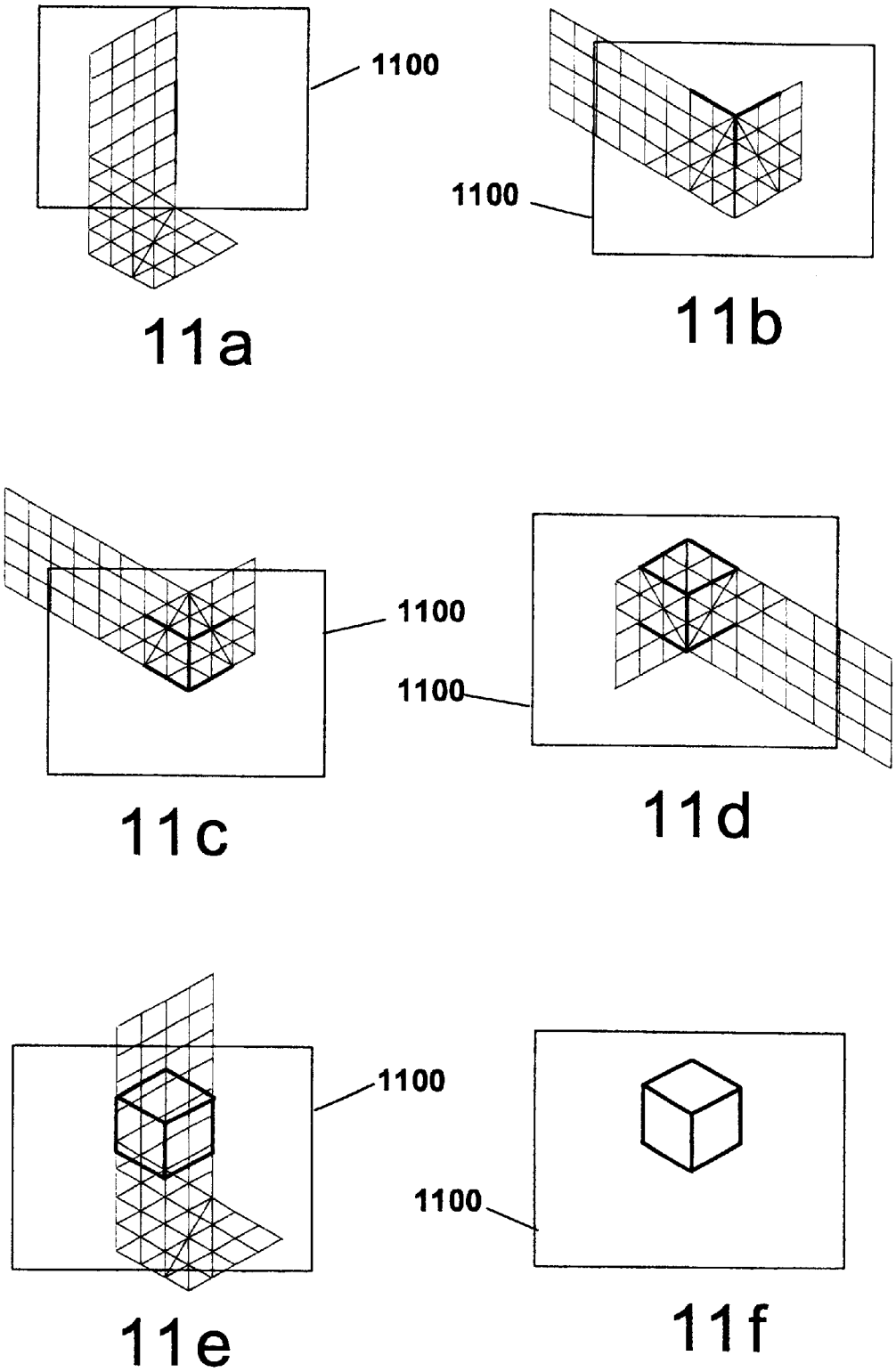
FIG. 11 depicts the steps utilized in drawing a cube in isometric projection using the drafting template of FIG. 8.

The use of the drafting template of the present invention is illustrated in FIG. 11 where the steps of drafting an isometric cube two inches (5.08 cm) on an edge are shown using the isometric template embodiment of FIG. 8. In the following discussion, references to lines on the cube being drawn in each step are taken from the isometric cube of FIG. 1*d*, while references to lines on the drafting template are taken from FIG. 8.

In FIG. 11, the rectangle 1100 represents a sheet of drafting paper. In FIG. 1*a*, line Q-NO-2 of the template is aligned with the bottom edge of the drafting paper, with edge QP of the template roughly centered on the page. The drafting pencil to moved along edge QP to generate a vertical line two inches (5.08 cm) in length for side 2-3 of the cube.

In FIG. 11*b* the template is rotated to present itself as an upright letter V, and apex-antapex reference line NQ is aligned with the vertical line just drawn. The drafting pencil is moved along edges PQ and QR of the template to draw edges 1-2 and 2-6 of the cube. The lines are each drawn two inches (5.08 cm) utilizing the scales along the edges PQ and QR of the template.

In FIG. 11*c*, the template is moved upwardly, keeping the apex-antapex reference line BQ aligned with edge 2-3 of the drawn cube until lines OP-2 and RM-2 of the template coincide respectively with lines 1-2 and 2-6 just drawn. This places edges NO and MN parallel to and spaced two inches (5.08 cm) from lines 1-2 and 2-6. The drafting pencil is moved along edges NO and MN to construct edges 4-3 and 3-7 of the cube. These lines are each drawn two inches (5.08 cm) in length using the scales along edges MN and NO.

In FIG. 11*d* the template is rotated to present itself as an inverted letter V, and the apex-antapex reference line NQ on the template is aligned with edge 2-3 of the drawn cube. The template is moved along this line until edge MN of the template is over point 1 of the drawn cube and edge NO of the template is over point 6 of the drawn cube. The drafting pencil is moved along edges MN and NO to construct edges 1-5 and 5-6 of the cube.

Finally, in FIG. 11*e*, line OP-2-MN-2, spaced two inches (5.08 cm) from edge NO is aligned with edge 2-3 of the cube and a two inch line is drawn along edge NO of the template to construct edge 1-4 of the drawn cube. Similarly, a line on the template, parallel to and spaced apart from edge PQ is aligned with edge 2-3 of the cube and line 6-7 of the cube is constructed along edge PQ of the template. (Because of the width of the template embodiment shown in FIG. 8, line OP-2-MN-2 is centered between edges NO and PQ. Hence in this special case, there is no need to move the template to draw cube edges 1-4 and 6-7.) If one were to use the trimetric or dimetric template embodiments of the present invention shown respectively in FIGS. 2 and 3 to draw respective trimetric and dimetric projections of a cube, similar steps would be used with these templates as depicted in FIG. 11. However, in these cases, as can be seen by reference to FIG. 1*b* and 1*c*, opposite corners of the top faces of the cubes are not aligned vertically. That is, in the trimetric projection of FIG. 1*b*, corner points 2 and 5 of top face 1-2-6-5 of the cube are not vertically aligned, nor are the corner points 2 and 5 of top face 1-2-6-5 of the dimetrically projected cube of FIG. 1*c*. In these two cases, vertical edge 2-3 is aligned, not with the apex-antapex reference line of the template for certain steps in drawing the cube, but with a line parallel thereto.

While there have been shown and described what are believed at present to be the preferred embodiments of the drafting template of the present invention, it will be obvious to one skilled in the art that various changes can be made therein without departing from the scope of the invention as it is defined in the appended claims.

I claim:

1. A drafting template for preparing axonometric drawings or sketches comprising a unitary, clear, substantially planar, chevron-shaped body having an apex and an antapex, an upper face, a lower face, and at least six edges, wherein the chevron-shaped body is divided into first and second legs by a line connecting said apex and said antapex.

2. A chevron-shaped drafting template according to claim 1 further comprising indicia affixed thereto for at least one of scaling and measuring such axonometric drawings or sketches prepared thereby.

3. A chevron-shaped drafting template according to claim 1 wherein said first and said second legs are of different lengths, said lengths being measured along a respective upper side edge of each of said legs from the apex to a point on each of said upper side edges distal from the apex, said upper side edges being defined when the chevron-shaped drafting template is viewed as an inverted letter "V".

4. A chevron shaped drafting template according to claim 1 wherein each of said first and said second legs of said chevron shaped body defines a figure selected from a trapezoid and a parallelogram.

5. A chevron shaped drafting template according to claim 1 wherein each of said first and said second legs of said chevron-shaped template defines a trapezoid.

6. A chevron shaped drafting template according to claim 1 wherein each of said first and said second legs of said chevron-shaped template defines a parallelogram.

7. A chevron-shaped drafting template according to claim 1, further comprising a third intermediate set of lines disposed between respective ones of lines in a first principal set of lines and spaced evenly from each other; and a fourth intermediate set of lines disposed between respective ones of lines in a second principal set of lines and spaced evenly from each other.

8. A drafting template for preparing axonometric drawings or sketches comprising a unitary, clear, substantially planar, chevron-shaped body having an apex and an antapex, an upper face and a lower face, first, second, third, fourth, fifth, and sixth edges, denominated as one moves in a clockwise manner about the chevron-shaped body, the first and second edges comprising upper side edges meeting at an obtuse interior angle of said drafting template to form the apex of the chevron-shaped body, the fourth and fifth edges comprising lower side edges meeting at an angle to form the antapex of the chevron-shaped body, when the chevron is viewed as an inverted letter "V"; the first and fifth side edges of the figure being spaced apart and parallel to one another and the second and fourth side edges being spaced apart and parallel to one another; the third edge comprising an end edge connecting an end of the second side edge at a point distal from the apex to a point of the fourth side edge distal from the antapex; and the sixth edge comprising an end edge connecting a point on the first side edge distal from the apex to the fifth side edge at a point distal from the antapex.

9. A chevron-shaped drafting template according to claim 8 further comprising a cut-out in at least one of said side and end edges thereof providing a mini-template.

10. A chevron-shaped template according to claim 9 wherein a shape of said cut-out mini-template is selected from an arc of a circle, an arc of an ellipse, or a polygon.

11. A chevron-shaped drafting template according to claim 9 wherein a said cut-out mini-template is provided in at least one of said third and sixth end edges of said drafting template.

12. A chevron-shaped drafting template according to claim 8 which further comprises indicia affixed thereto for at least one of scaling and measuring such axonometric drawings or sketches prepared thereby.

13. A chevron-shaped drafting template according to claim 12 wherein said indicia comprise a line connecting the apex and antapex and lines extending perpendicularly from a said side edge to said antapex.

14. A chevron-shaped drafting template according to claim 13 wherein said indicia comprise a first principal set of lines running parallel to said second side edge and said fourth side edge, disposed therebetween and equally spaced apart from one another, connecting said third end edge to at least one of the respective opposing side and end edge; and a second principal set of lines running parallel to said first side edge and said fifth side edge, disposed therebetween and equally spaced apart from one another, connecting said sixth end edge to at least one of the respective opposing side and end edge.

15. A chevron-shaped drafting template according to claim 14 wherein the lines in at least one of said first principal set of lines and said second principal set of lines are separated from each other by distances of one unit of measure as measured along the line connecting the apex and antapex of the template.

16. A chevron-shaped drafting template according to claim 15 wherein said unit of measure is one inch.

17. A chevron-shaped drafting template according to claim 15 wherein said unit of measure is one centimeter.

18. A chevron-shaped drafting template according to claim 14, further comprising a third intermediate set of lines disposed between respective ones of the lines in the first principal set of lines and spaced evenly from each other; and a fourth intermediate set of lines disposed between respective ones of the lines in the second principal set of lines and spaced evenly from each other.

19. A chevron-shaped drafting template according to claim 13 wherein said indicia further comprise a third principal set of lines parallel to the line connecting the apex and the antapex, connecting said second side edge to said fourth side edge, said third principal set of lines being disposed between the apex-antapex line and said third end edge and equally spaced from one another; and a fourth principal set of lines parallel to the line connecting the apex and antapex, connecting said fifth side edge to said first side edge, said fourth principal set of lines being disposed between the apex-antapex line and said sixth end edge and equally spaced from one another.

20. A chevron-shaped drafting template according to claim 19 wherein the lines in said third principal set of lines are separated from each other by distances of one unit of measure as measured along a line parallel to said second side edge, and the lines in said fourth principal set of lines are separated from each other by distances of one unit of measure as measured along a line parallel to said first side edge.

21. A chevron-shaped drafting template according to claim 20 wherein said unit of measure is one inch.

22. A chevron-shaped drafting template according to claim 20 wherein said unit of measure is one centimeter.

23. A drafting template for preparing trimetric projection drawings or sketches comprising a unitary, clear, substantially planar, chevron-shaped body having an apex and an antapex, an upper face and a lower face, first, second, third, fourth, fifth, and sixth edges, denominated as one moves in a clockwise manner about the chevron-shaped body, the first and second edges comprising upper side edges meeting at an angle to form the apex of the chevron-shaped body, the fourth and fifth edges comprising lower side edges meeting at an angle to form the antapex of the chevron-shaped body, when the chevron is viewed as an inverted letter "V"; the first and fifth side edges of the figure being spaced apart and parallel to one another and the second and fourth side edges being spaced apart and parallel to one another; the third edge comprising an end edge connecting an end of the second side edge at a point distal from the apex to a point of the fourth side edge distal from the antapex; and the sixth edge comprising an end edge connecting a point on the first side edge distal from the apex to the fifth side edge at a point distal from the antapex; a first angle formed between said first side edge and a line connecting said apex and said antapex being an acute angle other than 60°, and a second angle formed between said second side edge and the line connecting said apex and said antapex being of a value other than the value of said first angle, other than 60°, greater than 0°, but less than the difference between 180° and said first angle.

24. A chevron-shaped drafting template for preparing trimetric projection drawings or sketches according to claim 22, said chevron-shaped template being divided into first and second legs by a line connecting said apex and said antapex, said first and second legs defining parallelograms.

25. A chevron-shaped drafting template according to claim 23 for preparing trimetric projection drawings or sketches wherein said first angle has a value ranging between about 5° and about 55° or between about 65° and about 85°.

26. A chevron-shaped drafting template according to claim 21 for preparing trimetric projection drawings or sketches and further comprising indicia affixed in said drafting template, said indicia comprising a line connecting said apex and said antapex; lines extending perpendicularly from a said side edge to said antapex; a first principal set of lines running parallel to said second side edge and said fourth side edge, disposed therebetween and equally spaced apart from one another, connecting said third end edge to at least one of the respective opposing side and end edge; a second principal set of lines running parallel to said first side edge and said fifth side edge, disposed therebetween and equally spaced apart from one another, connecting said sixth end edge to at least one of the respective opposing side and end edge; a third principal set of lines parallel to the line connecting the apex and the antapex, connecting said second side edge to said fourth side edge, said third principal set of lines being disposed between the apex-antapex line and said third end edge and equally spaced from one another; and a fourth principal set of lines parallel to the line connecting the apex and the antapex, connecting said fifth side edge to said first side edge, said fourth principal set of lines being disposed between the apex-antapex line and said sixth end edge and equally spaced from one another.

27. A drafting template for preparing dimetric projection drawings or sketches comprising a unitary, clear, substantially planar, chevron-shaped body having an apex and an antapex, an upper face and a lower face, first, second, third, fourth, fifth, and sixth edges, denominated as one moves in a clockwise manner about the chevron-shaped body, the first and second edges comprising upper side edges meeting at an angle to form the apex of the chevron-shaped body, the fourth and fifth edges comprising lower side edges meeting at an angle to form the antapex of the chevron-shaped body, when the chevron is viewed as an inverted V; the first and fifth side edges of the figure being spaced apart and parallel to one another and the second and fourth side edges being spaced apart and parallel to one another; the third edge comprising an end edge connecting an end of the second side edge at a point distal from the apex to a point of the fourth side edge distal from the antapex; the sixth edge comprising an end edge connecting a point on the first side edge distal from the apex to the fifth side edge at a point distal from the antapex; a first angle formed between said first side edge and a line connecting said apex and said antapex being 60°, and a second angle formed between said second side edge and the line connecting said apex and said antapex being of a value other than 60°, greater than 0°, but less than the difference between 180° and said first angle.

28. A chevron-shaped drafting template, for preparing dimetric projection drawings or sketches according to claim 27, said chevron-shaped template being divided into first and second legs by a line connecting said apex and said antapex, said first and second legs defining parallelograms.

29. A chevron-shaped drafting template for preparing dimetric projection drawings according to claim 28 wherein said second angle has a value ranging between about 5° and about 55° or between about 65° and about 115°.

30. A chevron-shaped drafting template for preparing dimetric projection drawings or sketches according to claim 28 further comprising indicia affixed thereto and comprising a line connecting said apex and said antapex; a line extending perpendicularly from a said side edge to said antapex; a first principal set of lines running parallel to said second side edge and said fourth side edge, disposed therebetween and equally spaced apart from one another, connecting said third end edge to at least one of the respective opposing side and end edge; a second principal set of lines running parallel to said first side edge and said fifth side edge, disposed therebetween and equally spaced apart from one another, connecting said sixth end edge to at least one of the respective opposing side and end edge; a third principal set of lines parallel to the line connecting the apex and the antapex, connecting said second side edge to said fourth side edge, said third principal set of lines being disposed between the apex-antapex line and said third end edge and equally spaced from one another; and a fourth principal set of lines parallel to the line connecting the apex and antapex, connecting said fifth side edge to said first side edge, said fourth principal set of lines being disposed between the apex-antapex line and said sixth end edge and equally spaced from one another.

31. A drafting template for preparing isometric projection drawings or sketches comprising a unitary, clear, substantially planar, chevron-shaped body having an apex and an antapex, an upper face and a lower face, first, second, third, fourth, fifth, and sixth edges, denominated as one moves in a clockwise manner about the chevron-shaped body; the first and second edges comprising upper side edges meeting at an angle to form the apex of the chevron-shaped body, the fourth and fifth edges comprising lower side edges meeting at an angle to form the antapex of the chevron-shaped body, when the chevron is viewed as an inverted V; the first and fifth side edges of the figure being spaced apart and parallel to one another and the second and fourth side edges being spaced apart and parallel to one another; the third edge comprising an end edge connecting an end of the second side edge at a point distal from the apex to a point of the fourth side edge distal from the antapex; the sixth edge comprising an end edge connecting a point on the first side edge distal from the apex to the fifth side edge at a point distal from the antapex; a first angle formed between said first side edge and a line connecting said apex and said antapex being 60°, and a second angle formed between said second side edge and the line connecting said apex and said antapex being 60°.

32. A chevron-shaped drafting template for preparing isometric projection drawings or sketches according to claim 31, said chevron-shaped drafting template being divided into first and second legs by said line connecting said apex and said antapex, said first and second legs defining parallelograms.

33. A chevron-shaped drafting template for preparing isometric projection drawings or sketches according to claim 32 wherein said first and second legs of said template are of different lengths, said lengths being measured from said apex respectively along the first and second side edges of said respective first and said second legs.

34. A chevron-shaped drafting template for preparing isometric projection drawings or sketches according to claim 33 further comprising indicia affixed thereto and comprising a line connecting said apex and said antapex; a line extending perpendicularly from a said side edge to said antapex; a first principal set of lines running parallel to said second side edge and said fourth side edge, disposed therebetween and equally spaced apart from one another, connecting said third end edge to the respective opposing side and/or end edge; a second principal set of lines running parallel to said first side edge and said fifth side edge, disposed therebetween and equally spaced apart from one another, connecting said sixth end edge to the respective opposing side and/or end edge; a third principal set of lines parallel to the line connecting the apex and the antapex, connecting said second side edge to said fourth side edge, said third principal set of lines being disposed between the apex-antapex line and said third end edge and equally spaced from one another; and a fourth principal set of lines parallel to the line connecting the apex and the antapex, connecting said fifth side edge to said first side edge, said fourth principal set of lines being disposed between the apex-antapex line and said sixth end edge and equally spaced from one another.

35. A chevron-shaped drafting template for preparing isometric drawings or sketches according to claim 34 wherein the lines in at least one of said first principal set of lines and said second principal set of lines are spaced apart from one another by distances of one unit of measure as measured along said line connecting said apex and said antapex; wherein the lines in said third principal set of lines are spaced apart from one another by distances of one unit as measured along a line parallel to said second side edge; and wherein the lines in said fourth principal set of lines are spaced apart by distances of one unit of measure as measured along a line parallel to said sixth side edge.

36. A chevron-shaped drafting template for preparing isometric drawings or sketches according to claim 35 wherein said unit of measure is one inch (2.54 cm).

37. A chevron-shaped drafting template for preparing isometric drawings or sketches according to claim 35 wherein said unit of measure is one centimeter.

38. A chevron-shaped drafting template for preparing isometric drawings or sketches according to claim 35 further comprising a third intermediate set of lines disposed between respective ones of the lines in the first principal set of lines and spaced evenly from each other; and a fourth intermediate set of lines disposed between respective ones of the lines in the second principal set of lines and spaced evenly from each other.

39. A chevron-shaped drafting template for preparing isometric drawings or sketches according to claim 35 further comprising a ruler scale disposed along one or more side or end edges thereof.

40. A chevron-shaped drafting template for preparing isometric drawings or sketches according to claim 39 wherein said ruler scale is true scale.

41. A chevron-shaped drafting template for preparing isometric drawings or sketches according to claim 31 wherein said first, second, third, fourth, fifth, and sixth edges of said chevron-shaped drafting template are inset from their respective true positions by a distance sufficient to accommodate the thickness of a standard mechanical drafting pencil.

42. A chevron-shaped drafting template for preparing isometric drawings or sketches according to claim 41 wherein said inset distance is 0.5 mm (0.02 inch).

43. A drafting template for preparing axonometric drawings or sketches comprising a unitary, clear, substantially planar, chevron-shaped body having an apex and an antapex, an upper face, a lower face, at least six edges, and indicia affixed thereto for scaling such axonometric drawings or sketches prepared thereby, said indicia comprising a first principal set of lines running parallel to said second side edge and said fourth side edge, disposed therebetween and equally spaced apart from one another, connecting said third end edge to said first side edge; and a second principal set of lines running parallel to said first side edge and said fifth side edge, disposed therebetween and equally spaced apart from one another, connecting said sixth end edge to said second side edge; a third principal set of lines parallel to a line connecting said apex and said antapex, connecting said second side edge to said fourth side edge, said third principal set of lines being equally spaced from one another; and a fourth principal set of lines parallel to a line connecting said apex and said antapex, connecting said fifth side edge to said first side edge, said fourth principal set of lines being equally spaced from one another, wherein the lines in at least one of said first principal set of lines and said second principal set of lines are separated by distances of one unit of a first unit of measure, and wherein the lines in at least one of said third principal set of lines and said fourth principal set of lines are separated by distances of one unit of a second unit of measure.

44. A chevron-shaped drafting template according to claim 43, said template having an outer edge perimeter adjusted inwardly or inset from a position of the perimeter consistent with the first and second units of measure to leave a gap around the perimeter of the template of about 0.5 mm (0.02 inch), the approximate width of standard mechanical drafting pencil lead.

45. A chevron-shaped drafting template according to claim 43 wherein at least one of the first and second units of measure is one inch.

46. A chevron-shaped drafting template according to claim 43 wherein at least one of the first and second units of measure is one centimeter.

47. A chevron-shaped drafting template according to claim 43 further comprising cut-outs in one or more side or end edges thereof providing mini-templates selected from an arc of a circle, an arc of an ellipse, or a polygon.

48. A chevron-shaped drafting template according to claim 43 wherein said indicia further comprise a line connecting the apex and the antapex and lines drawn perpendicularly from a said side edge to said antapex.

49. A chevron-shaped drafting template according to claim 43 further comprising a third intermediate set of lines disposed between respective ones of the lines in the first principal set of lines and spaced evenly from each other; and a fourth intermediate set of lines disposed between respective ones of the lines in the second principal set of lines and spaced evenly from each other.

50. A drafting template for preparing axonometric drawings or sketches comprising a unitary, clear, substantially planar, chevron-shaped body having an apex and an antapex, an upper face, a lower face, indicia affixed thereto for scaling and measuring such axonometric drawings, an end zone, and first, second, third, fourth, fifth, and sixth edges, said edges being denominated as one moves in a clockwise manner about the chevron-shaped body, the first and second edges comprising upper side edges meeting at an angle to form the apex of the chevron-shaped body, the fourth and fifth edges comprising lower side edges meeting at an angle to form the antapex of the chevron-shaped body, when the chevron is viewed as an inverted letter "V"; the first and fifth side edges of the figure being spaced apart and parallel to one another and the second and fourth side edges being spaced apart and parallel to one another; the third edge comprising an end edge connecting an end of the second side edge at a point distal from the apex to a point on the fourth side edge distal from the antapex; and the sixth edge comprising an end edge connecting a point on the first side edge distal from the apex to the fifth side edge at a point distal from the antapex, said indicia comprising a line connecting said apex and said antapex; a first principal set of lines running parallel to said second side edge and said fourth side edge, disposed therebetween and equally spaced apart from one another, connecting said third end edge to at least one of the side and end edge opposite thereof; a second principal set of lines running parallel to said first side edge and said fifth side edge, disposed therebetween and equally spaced apart from one another, connecting said sixth end edge to at least one of the side and end edge opposite thereof; a third intermediate set of lines disposed between respective ones of the lines in at least one of the first principal set of lines and the second principal set of lines and spaced evenly from each other, said end zone being disposed at or near one or both of the third and sixth end edges, said end zone comprising end zone indicia, said end zone indicia comprising lines, evenly-spaced and parallel to a respective one or both of the third and sixth end edges, wherein intersection of end zone indicia lines with one or more of ones of the respective principal sets of lines defines angles having values other than 90°.

51. A chevron-shaped drafting template according to claim 50, further comprising a cut-out in at least one of said side and end edges thereof, providing a mini-template selected from an arc of a circle, an arc of an ellipse, or a polygon.

52. A chevron-shaped drafting template according to claim 50 wherein said indicia further comprise lines drawn perpendicularly from a said side edge to said antapex.

* * * * *